United States Patent [19]

Curry et al.

[11] 4,116,331

[45] Sep. 26, 1978

[54] HEAT INSTALLED MULTI-PACK CARRIER, MACHINE AND METHOD

[76] Inventors: Byron V. Curry, 1150 Oriole Rd., Montecito, Calif. 93108; Teofil L. Bonkowski, 978 El Camino Ave., Stockton, Calif. 95207

[21] Appl. No.: 629,769

[22] Filed: Nov. 7, 1975

Related U.S. Application Data

[63] Continuation-in-part of Ser. No. 583,183, Jun. 2, 1975.

[51] Int. Cl.[2] ..... B65D 75/00

[52] U.S. Cl. ..... 206/150; 206/432; 206/497

[58] Field of Search ..... 206/150, 151, 497, 432

[56] References Cited

U.S. PATENT DOCUMENTS

| | | | |
|---|---|---|---|
| 3,046,711 | 7/1962 | Harrison | 206/497 |
| 3,200,944 | 8/1965 | Rapata | 206/432 |
| 3,353,326 | 11/1967 | Becker | 206/497 |
| 3,355,013 | 11/1967 | Poupitch | 206/150 |
| 3,374,028 | 3/1968 | Wanderer | 206/150 |
| 3,792,562 | 2/1974 | Gilliam | 53/30 |

FOREIGN PATENT DOCUMENTS

| | | | |
|---|---|---|---|
| 2,207,523 | 8/1973 | Fed. Rep. of Germany | 206/497 |

*Primary Examiner*—Herbert F. Ross

*Attorney, Agent, or Firm*—Spensley, Horn & Lubitz

[57] ABSTRACT

A carrier is disclosed for interconnecting an array of cans or the like to hold them together as a unitary package. Preferably the carrier is made from a sheet of a material such as polyvinyl chloride that may be cut, expanded and set in its expanded state, then later after being placed around an array of cans, shrunk to interconnect the cans and form a package. Because of the design of the carrier and its method of application to an array of cans, a cover film may be attached by the carrier over the array of cans to keep the can tops clean. Machines and methods are disclosed for forming, transporting and applying in a rapid and economic manner, a web of such carriers to a series of cans or the like.

13 Claims, 18 Drawing Figures

HEAT INSTALLED MULTI-PACK CARRIER, MACHINE AND METHOD

PRIOR APPLICATION

This application is a continuation-in-part of an application bearing the same title and filed by the same inventors in the U.S. Patent Office on June 2, 1975, Ser. No. 583,183. The benefit of the filing date of this earlier application is claimed for the common subject matter.

BACKGROUND OF THE INVENTION

The invention is concerned generally with the art of packaging, and more particularly with a multi-pack carrier for an array of cylindrical containers, such as the common 6-pack beverage can carrier.

As is well known, a wide variety of articles are packaged in containers which are interconnected and sold as a single unit. For example, it has been estimated that on the order of 40 billion beverage cans will be produced this year, most of which will be packaged in units of six, these cans being interconnected by a simple plastic sheet or structure that also serves as their carrier. There are many packages of this general type, representative carriers and packaging machines being disclosed by Poupitch in U.S. Pat. Nos. 2,874,835, 2,929,181 and 2,936,070; by Hull et al., in U.S. Pat. No. 3,032,944; by Fisher in U.S. Pat. No. 3,044,230; and by the applicants in their U.S. Pat. Nos. 3,134,485 and 3,206,019. Many of these carriers and machines are complex. Also, most of them do not protect the tops of the packaged cans from contamination or soiling, nor do they permit a cover film to be added for this purpose.

Among the objects of the present invention is the provision of a simple carrier that easily may be applied to interconnect an array of cans or the like and securely hold them together even when the resulting package is handled roughly. This carrier should permit a simple mechanism for applying it to an array of cans, a mechanism being adapted to a rapid, high-volume, on-line production. The carrier and mechanism also should permit a film to be placed over the array during the packaging operation to protect the can tops and maintain them in a clean condition until unpackaged. These and other objects will be apparent from the following description of the invention.

BRIEF DESCRIPTION OF THE INVENTION

The invention provides a carrier that may, in an expanded state be placed around an array of cans or other elements to be interconnected as a package, then by application of an external force such as heat, be caused to shrink about the cans to firmly hold them together as a unit. Preferably this carrier is formed from a sheet of a material such as polyvinyl chloride plastic, a material that may be cut, partially expanded and set in this expanded state. When so formed, the carrier will incorporate a plurality of openings, each intended to receive one can. After being placed around an array of cans, the carrier is caused to shrink back towards its original, unexpanded state, contracting about the cans and interconnecting them as a package. Preferably, a sheet of such a material in its unexpanded state, but cut to form a web of carriers, is employed to form the individual carriers and successive packages by being expanded, set in an expanded state, then applied about an array of cans and shrunk to interconnect the cans. However, a sheet of such a material in an expanded state also may be employed to form the carrier. Thus, an inexpensive carrier is provided, one which is adapted to simple methods and mechanisms for forming it and for applying it about an array of cans.

Contemplated within the scope of the invention are machines for cutting a sheet of such a material and forming an interconnected series of carriers as well as machines for applying this web of carriers to a series of cans, interconnecting them as a sequence of packages. Preferably the machine for forming the series of carriers, or carrier web, from a sheet accepts a continuous sheet of a plastic material that may be expanded and set in an expanded state. This sheet is cut to provide a series of carriers, each carrier having openings for an array of cans, the carriers being interconnected each with the next by convoluted strips in one embodiment of the invention. To provide openings for the array of cans in the carrier, the material is heated about each opening intended to receive a can and shaped to form a collar of a size which readily accepts an article to be packaged, the collar material being expanded during this operation and set in the expanded state. The machine for packaging arrays of cans or the like employs this performed series of carriers, or carrier web. It applies the carriers in a continuous operation to a series of cans, slipping the carrier down about each can so that the collar is located about the neck area of the can. The carrier then is heated, causing each collar to contract about the can it receives thereby interconnecting the cans as a package. After interconnecting the cans, the carriers may be cut from one another to separate the packages. A cover film may be provided within the packaging machine and placed over the tops of the cans prior to the carrier being applied, the carrier serving to hold this cover film about the top of each can thereby sealing it against contamination until the package is opened.

Also contemplated within the scope of this invention is a carrier design permitting the continuous web of carriers to be wrapped about a drum for storage or transportation. Since the carriers are preformed to incorporate upstanding collar areas about each opening that receives a can, simply wrapping the web of carriers about a drum would tend to collapse the collar areas and ruin the carriers. To avoid this, in one embodiment each carrier is interconnected with adjacent carriers by one or more convoluted strips permitting the carriers to move apart a limited amount. Such a web of carriers may be applied about a drum, preferably a drum incorporating on its surface upstanding areas that receive and nest with the collar opening of each carrier. Subsequent layers about the drum continue this nesting, the carriers gradually separating and stretching the convoluted strips as the circumferential distance about the drum increases. Upon reaching the limit of expansion between the carriers provided by the convoluted strips interconnecting them the wrapping may be terminated or a separator strip interleaved with the carriers wrapped about the drum, the inner surface of the separator strip nesting with the wrapped carrier, the outer surface including raised areas that define a new carrier spacing in which the convoluted strips are not substantially stretched. The carrier being wrapped about the drum then continues on a new pattern established by the outer surface of the interleaved separator. By employing several interleaved separator strips, a substantial length of preformed carrier web may be wrapped about and carried upon a single drum. This permits the preforming operation of the carrier web to be separate from the application of the carriers to the array of cans during the packaging operation.

This invention further contemplates various methods, including a method of packaging. One method employs a carrier sheet of a material that may be cut, expanded, and set in an expanded state then placed about an array of articles to be packaged and shrunk to its initial unexpanded form by application of an external force. To employ this method to package an array of cans, preferably such a sheet is cut to provide a carrier having openings smaller than the neck diameter of the cans. These openings are expanded to a size sufficient to receive easily the cans to be packaged and the openings are set in this expanded condition. Next, the carrier is placed about an array of articles to be packaged, each article being received in one of the expanded openings in the sheet, and the openings then are shrunk by application of an external force to grip and interconnect the articles, forming a package. Another method within the scope of this invention employs a drum to carry an interconnected series or web of carriers preformed as just described, the method consisting of providing a pattern of raised areas about the surface of the drum to nest with the preformed collars in the web of interconnected, expanded carriers. Expandable elements are employed to interconnect the carrier of the web. Thus as the web of interconnected carriers is wrapped about the drum, the expandible elements permit the carriers to separate and nest each with the one underlining it. When the carrier has reached the limit of its expandability, a separator sheet is interleaved with the web about the drum. This separator sheet is formed on one side of nest with the expanded carrier pattern underlying it and on the other side to establish a new pattern for the carrier web overlying it with the interconnecting expandable elements between the carriers in a substantially unexpanded state.

BRIEF DESCRIPTION OF THE DRAWINGS

The invention will be further described in connection with the accompanying drawings in which.

DETAILED DESCRIPTION OF THE INVENTION

Figure 1:
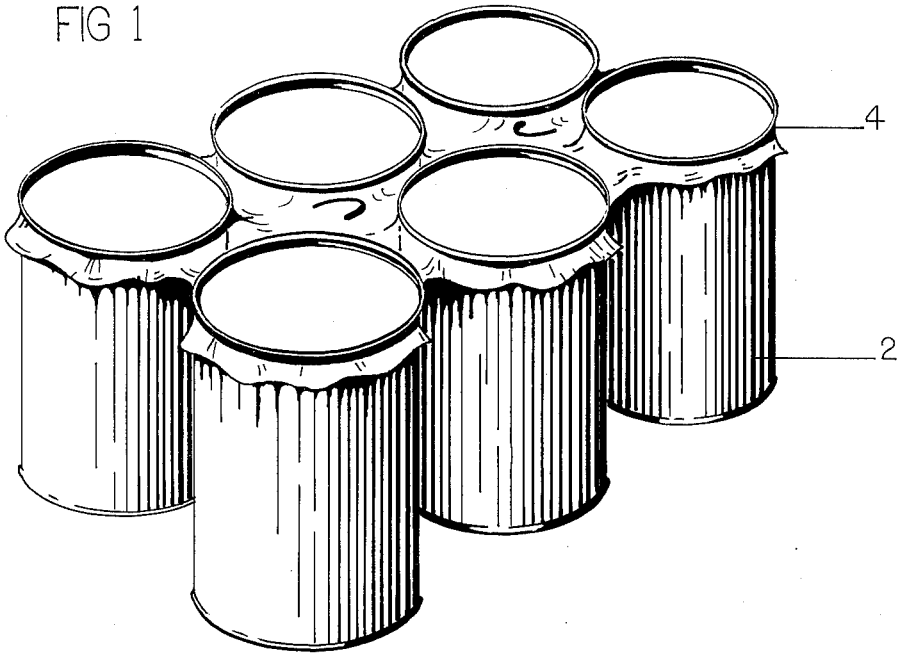
FIG. 1 is a perspective view of an array of cans interconnected by a carrier formed in accordance with the present invention.

A preferred application of the invention is to interconnect an array of six or eight cylindrical cans as a single, unitary package. Of course, the invention is of much broader application than this and, for example, can be used to interconnect an array of almost any number of elements, each element having any of various different shapes. In addition, while it is preferred to use a shrinkable plastic material to interconnect these cans upon application of heat, other materials exist and may be developed which will satisfactorily perform as the sheet material of the carrier upon application of an external force in accordance with the principals set forth herein. Accordingly, while these and other preferred elements and applications of the invention are set forth in the following detailed description, the invention is not so limited either in concept or in application.

There are at least three different approaches taught herein which may be followed to form a package employing a heat shrinkable plastic material. A first approach employs a sheet of biaxially oriented plastic material, which is a sheet which has been stretched in orthogonal directions at least 10 percent, usually much more, and set in this stretched state. In its simplest form, the package may be formed by (1) cutting openings in this sheet, (2) placing the sheet about an array of cans or the like, and then (3) heating the sheet to shrink it about the array. When the film has been biaxially stretched or expanded different amounts in different directions, to achieve a uniform band encircling each can of the array, it is necessary to cut elliptical holes in the sheet, the shape of the ellipse being determined by the different elongations of the sheet in the different directions and ths shape of the can. Of course, a uniaxially oriented sheet of such material also may be used in generally the same fashion, if desired. A second approach to forming a carrier achieves better control the characteristics of the resultant package by performing a biaxially oriented sheet to provide openings about which collars have been shaped, the sheet and collars shrinking about the array of cans. A third approach, one offering great versatility and economy, employs a sheet of such a material but in a non-oriented or unexpanded state, a material that may be expanded, set, then later caused to contract towards its original, unexpanded state. By application of an external force such as heat, a portion of this material is expanded and set to form a collar, then after being placed about an array of cans caused to reassume its initial shape to form a package. preferably, this sheet of unoriented material is cut to form a web of interconnected, flat carriers, shipped to the site of the packaging operation, then there preformed, placed about a series of cans, shrunk, and the carriers separated to form a series of separate packages.

There are many materials capable of being expanded, set, then later contracted. Among them are linear polyamides, (sometimes referred to by the trade name "Saran"), polymers formed from unsaturated hydrocarbons of the olefin series, such as polyethylene and polypropylene, especially those cross-linked by irradiation, resins of polyvinyl chloride and polyvinyl benzene series (sometimes referred to as "Styrene"), and substitution resins of the polyvinyl benzene series such as polyvinyl butyrate and polyvinyl acetate.

Polyvinyl chloride is at present the preferred material. While other materials may be cheaper per pound, a relatively thin sheet of polyvinyl chloride will have the same strength, or structural integrity, as a much thicker sheet of another plastic material such as polyethylene. For example, a 0.004 or 0.005 inch sheet of polyvinyl chloride will have about the same structural integrity as, and preform as a carrier in a manner comparable to, a sheet of 0.015 or 0.020 inch polyethylene. Thus, a polyvinyl chloride carrier can be significantly less expensive than a carrier of most any other plastic material.

Employing sheets of polyvinyl chloride in an unstretched or unexpanded condition permits additional savings to be realized. A sheet of such a material in an unexpanded condition may be formed as a carrier by cutting openings in it, then heating and stretching the areas about these openings to preform collars of a size sufficient to readily accept cans of the array. The collars may be of a width necessary to adequately grip the articles, a wider collar more firmly holding the article about an array of cans. Upon application of heat, the collars may be shrunk about the array to interconnect them as a package. In addition to the economy realized by this approach, since the center portion of the carrier sheet has not been stretched (as is the case when a biaxially oriented sheet is employed) it does not contract appreciably and therefore will not upset or affect the placement of the cans in the array. When the packaging operation is proceeding on a high speed line, maintaining a stabilized position of the cans in the array can be another quite important advantage of this third approach. Whatever approach is employed in providing a carrier, another very important advantage of the carrier disclosed herein is that it permits a protective film to be applied over the tops of the array of cans prior to the carrier being applied, the carrier serving to hold this cover film over the top of each can thereby sealing it against contamination until the package is opened. These preferred forms of carriers, and the methods and machines for forming and applying them, now will be described.

In FIG. 1 an array of six cans 2 are shown interconnected by a carrier 4. This carrier is positioned about the upper end of each can and has an opening which receives each can, the carrier forming a collar about each received can. This collar bears upon the can, hold the can, and interconnects the array as a unitary package. Because of the many cans packaged in such a fashion as this, such a package probably is quite familiar in appearance. It also is deceptively simple. Since the top rim of any ordinary can is larger than its body, an opening must be provided in the carrier that is large enough to permit the top rim of the can to pass through it. This openinng then must somehow be reduced in size to cause the margin area surrounding it to firmly grasp the can, interconnecting the array as a package. Obviously, the requirement that the size of the opening in the carrier be large enough to pass over the top rim of the can conflicts with the requirement that the margin area about the opening firmly grasp the can. This conflict in requirements has challenged the ingenuity of packaging engineers for decades.

Figure 2:
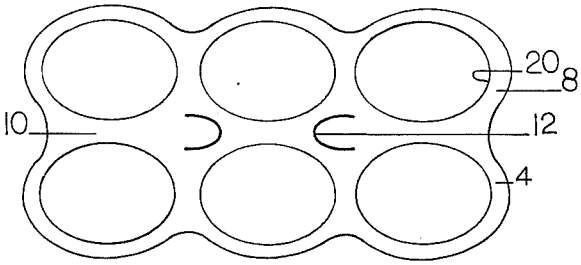
FIG. 2 is a plan view of a preferred carrier.

In FIG. 2 is shown a carrier 4 formed in accordance with the principals of one embodiment of the invention. This carrier preferably is cut from a sheet of oriented, heat shrinkable plastic material, such as a polyvinyl chloride. Such plastic sheet materials are quite common and may be produced from many different plastics so as to contract an amount that may be predetermined over a wide range. The contraction of such an oriented sheet may be adjusted to be different in different directions. For example, commonly such a sheet material is extruded as a tube then, as it cools, stretched both longitudinally and transversely a given amount. Later, this sheet may be heated to contract approximately by the amount it was stretched, the contraction in each direction being proportional to the stretch imparted in that direction.

For reasons that will be stated during the discussion of one preferred machine constructed in accordance with the principals of this embodiment of the invention, in this embodiment of the invention it is preferred that such a plastic sheet material be employed as a carrier that has been stretched or biaxially oriented approximately 10 percent in one direction, termed the longitudinal direction, and 30 percent in the other direction, termed the transverse direction. Because of the relatively small amount of stretch of the preferred sheet in the longitudinal direction, when placed and shrunk about an array of cans in a packaging line little distortion of the can location will result in the longitudinal direction, these minimizing the space required by, and the positional changes produced by, the packaging operation. However, sheets shrinking by as much as 65 percent have been employed successfully, as well as sheets with a longitudinal shrinkage of less than 10 percent.

Other plastic materials than polyvinyl chloride (PVC) may be employed. Some examples of such materials are linear polyamides, (sometimes referred to by the trade name "Saran"), polymers formed from unsaturated hydrocarbons of the olefin series, such as polyethylene and polypropylene, especially those cross-linked by irradiation, resins of polyvinyl chloride and polyvinyl benzene series (sometimes referred to as "Styrene") and substitution resins of the polyvinyl benzene series such as polyvinyl butyrate and polyvinyl acetate. While polyethylene (PE), for example, has performed satisfactorily as a carrier and is cheaper per pound at present than PVC, a PE sheet tends to be more flexible, relax more readily, and slip more easily than a PVC sheet of the same thickness. Accordingly, more PE is required to provide a suitable carrier, which more than offsets its present cost advantage. For example, a typical PVC heat shrinkable film having an initial thickness on the order of 0.005 or less inches is quite satisfactory, while a PE film of 0.015 to 0.020 inches would be required to form a comparable package.

If a circular opening were provided in such a sheet material, upon being heated it would contract and the circular opening would distort into an elliptical shape simply because the contraction of the sheet in different directions would be different. Since it is preferred to provide a carrier for six circular cans, the carrier 4 is cut to provide a series of six elliptical openings 6. If circular openings nevertheless were provided, while the resultant carrier may function satisfactorily the band surrounding each can would tend to vary in width and thickness due to the differential shrinkage and be weaker in some areas than others. A margin area 8 is provided about each opening 6, the carrier 4 including a central area 10 interconnecting the margin areas 8 about the six openings. Two crescent shaped opening 12 are cut into this central area 10 of the carrier to provide the ordinary finger holes for manually grasping the array of cans interconnected by the carrier. Other openings may be provided for hanging, displaying, or interlinking the package if desired.

Figure 3:
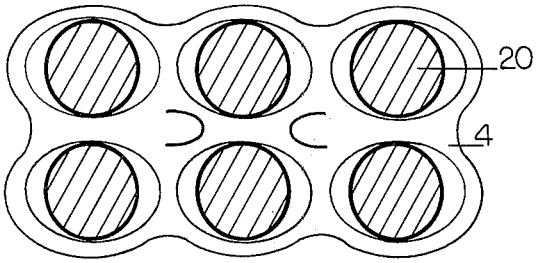
FIG. 3 is a plan view of a preferred carrier placed about an array of cans to be interconnected as a package.
Figure 4:
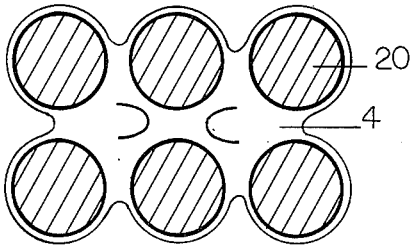
FIG. 4 is a plan view of the cans shown in FIG. 3 after being interconnected by the carrier as a package.

FIG. 3 illustrates this carrier 4 placed, as by hand, about an array of six cans 20. Preferably the carrier is positioned about the top or end portion of each can, slightly underlying the normal bead which results from the connection of the top of the can to the side wall of the can. Heat then is applied preferably in a uniform fashion to one fact of the carrier from below the array of cans. This heat causes the plastic sheet material of the carrier to shrink, reducing the size of each opening 6 and causing the collar areas 8 to tend to turn towards the source of heat. The size of the elliptical openings 6 is such, in relation to the size of the cans to be packaged, that upon application of heat the plastic material shrinks about each can to firmly grasp it, the margin areas 8 turning down to provide a collar about the top end of each can as shown in FIG. 1. In this simple fashion, the array of cans are interconnected by the carrier as a unitary package. The top view of this package is shown in FIG. 4.

The heat to shrink the carrier may be applied using any convenient source, such as an infra-red lamp, hot air, or steam. Tests indicate that directing a flow of steam onto the carrier results in a uniform, controlled shrinkage, possibly because such a heat source can be well controlled both in temperature and pressure flow characteristics. For this reason, it is preferred by many in this field.

Figure 5:
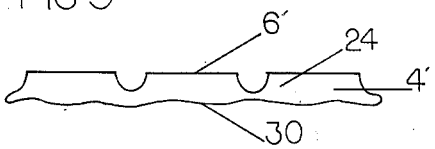
FIG. 5 is a view in elevation of another preferred, preformed carrier of the invention.

For various reasons, including positive control of the shape of the plastic sheet and to minimize the shrinkage required to form the package and thus the time required to form the package, for at least some applications it is preferable to preform the carrier shown in FIG. 1 to first provide a series of collar areas 24. This preforming results in a carrier such as shown in FIG. 5. The collar areas 24 conveniently may be formed by, for example, placing the carrier over a heated male mold, the mold being shaped to turn the margin area about each opening outward to form a collar. The carrier then is cooled, as by cooling the mold, to set the carrier in this partially contracted shape. Beginning with, for example, a PVC film of 0.0025 inches and form a collar just large enough to conveniently fit about one of the cans to be packaged. It will be noted that when so formed the carrier 4' tends to have a clean, sharply defined margin about each opening 6'. However, the lower edge or shoulder area 30 about each collar tends to be slightly ruffled, apparently due at least in part to the slight differences in contraction of the plastic sheet material during the preforming operation.

The width of the collar may be adjusted, depending on the size and weight of the articles to be packaged, to exert a gripping force about each article sufficient to hold it in the package. Generally, the greater the width of the collar, the greater the holding force exerted by the collar about the article upon which it has been contracted. Of course, other forces enter into this as well, including the degree of stretch imparted to the material forming the collar. Nevertheless, adjusting the collar width provides a simple, convenient method for adjusting the hold force exerted by the carrier upon the package article.

Figure 6:
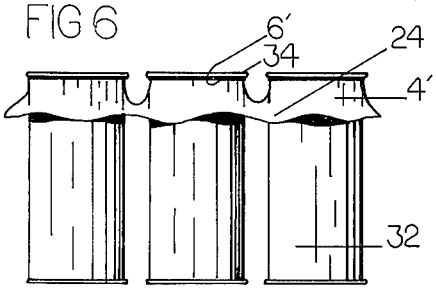
FIG. 6 is a view in elevation of the top portion of a series of cans interconnected by the preformed carrier.

As shown in FIG. 6 such a preformed carrier may be placed around an array of cans 32 with each opening 6' underlying the normal bead 34 at the top of each can. While held in this position, the carrier may be further shrunk by application of heat to cause the collars 24 to firmly grip the top margin of each can in the area underlying the bead. This will interconnect the array of cans as a package resulting in a structure such as shown in FIG. 6. The bearing of the edge under the bead best resists the normal downward force tending to free the cans as the resultant package is being held by the carrier.

Figure 7:
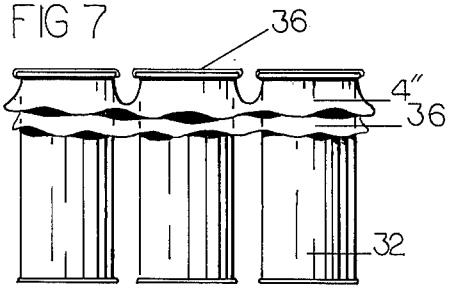
FIG. 7 is a view in elevation similar to FIG. 6 with a cover film held about the tops of the cans by the preformed carrier.

It is important in a significant number of applications to be able to keep the top of each can in the package clean from the time it is packaged to the time it is removed from the package. As shown in FIG. 7, the carrier of this invention easily permits such an important result to be achieved. For this, a thin film of a material 36 such as a low density polyethylene first may be placed over the tops of the array of cans, then the carrier may be placed over the tops of the array of cans, then the carrier 4'' positioned about the cans, the collar areas pulling the thin cover film of plastic tight about the top of each can. Heat is applied to shrink the collars of the carrier about the cans, the collars now not only grasping each can firmly and interconnecting them as a package, but also holding the cover film material 36 to protect the top of each can. There exists a wide range of materials, plastic or otherwise, from which such a thin cover may be produced, with the final choice being dependent upon the preferences of the packager. It is important to consider, however, that the cover film need not necessarily resist the heat employed to shrink the carrier. To the contrary, it may be preferred that such heat causes the cover film in the margins around and between the cans to shrink so excessively so as to almost disappear, since this will in no way adversely affect the protection afforded by the cover film portions convering the tops of the cans. by applying the heat from below, such portions are not subjected to any significant heat, and are substantially protected from any divergent heat by the carrier. Of course, advertising or other information may be imprinted upon this cover film and upon the carrier as well to further assist in marketing of the packaged product.

Figure 8:
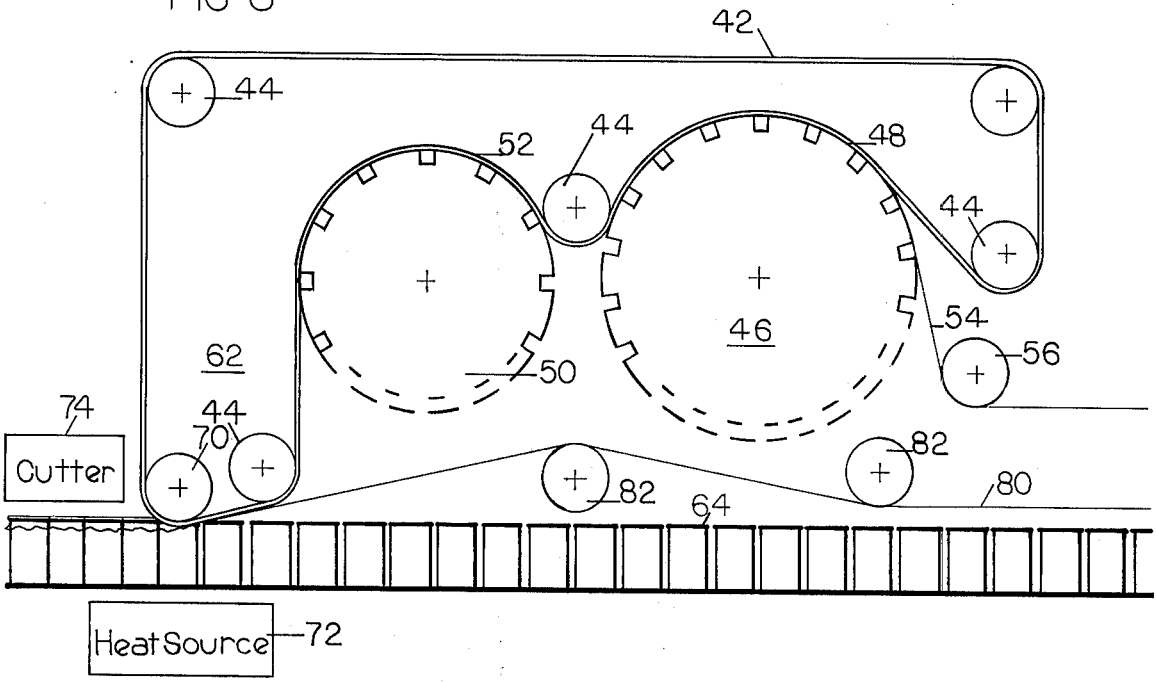
FIG. 8 is a plan view of the major elements of a machine for packaging a series of cans on a conveyor employing a preferred form of the carrier to interconnect and package the cans in arrays of six.

An important feature of the present invention is its adaptability to high volume packaging applications with amazingly simple machinery. An example of such a machine is shown in FIG. 8. It includes a belt 42 of unique characteristics, the belt passing over a series of idler pulleys 44, about a portion of the periphery of a heated drum 46 bearing a series of shaped elements 48 on its periphery, and then about a cooled drum 50 also bearing a series of shaped elements 52 on its periphery. A continuous web 54, consisting of an endless sseries of pre-cut carriers preferably shaped as shown in FIG. 2 and formed from a heat shrinkable plastic sheet material, is fed about an idler pulley 56 and into the bite between the belt 42 and 46. As this pre-cut web 54 is brought into contact with drum 46 by belt 42, it is pressed about the heated elements 48 carried on the periphery of the drum.

Figure 9:
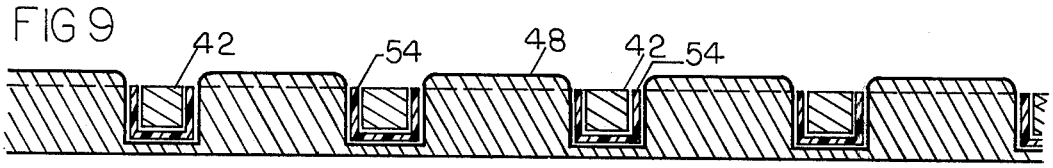
FIG. 9 is a cross-sectional view of a portion of the machine shown in FIG. 8.

A developed view of a portion of drum 46 is shown in FIG. 9. The belt 42 is formed and shaped to press the plastic web 54 into engagement with the heated elements 48 about the periphery of the heated drum 46. The temperature and duration of the heat applied by the drum to the web is sufficient to cause the web to partially contract about the elements 48 and to be shaped into a form generally as shown in FIG. 5. The web leaves drum 46, passes around idler roller 44 (the shape of the collars formed in the web by the heated drum being preserved by the belt) and to the cooling drum 50 where the partially contracted shape of the web is set and stabilized by elements 52 similar to elements 48. The web then is carried by the belt down about an idler roller and to an application or packaging station 62 where it is applied to an array of cans 64 on a conveyor belt 66 moving in the direction indicated by arrow 68 in FIG. 8.

Figure 10:
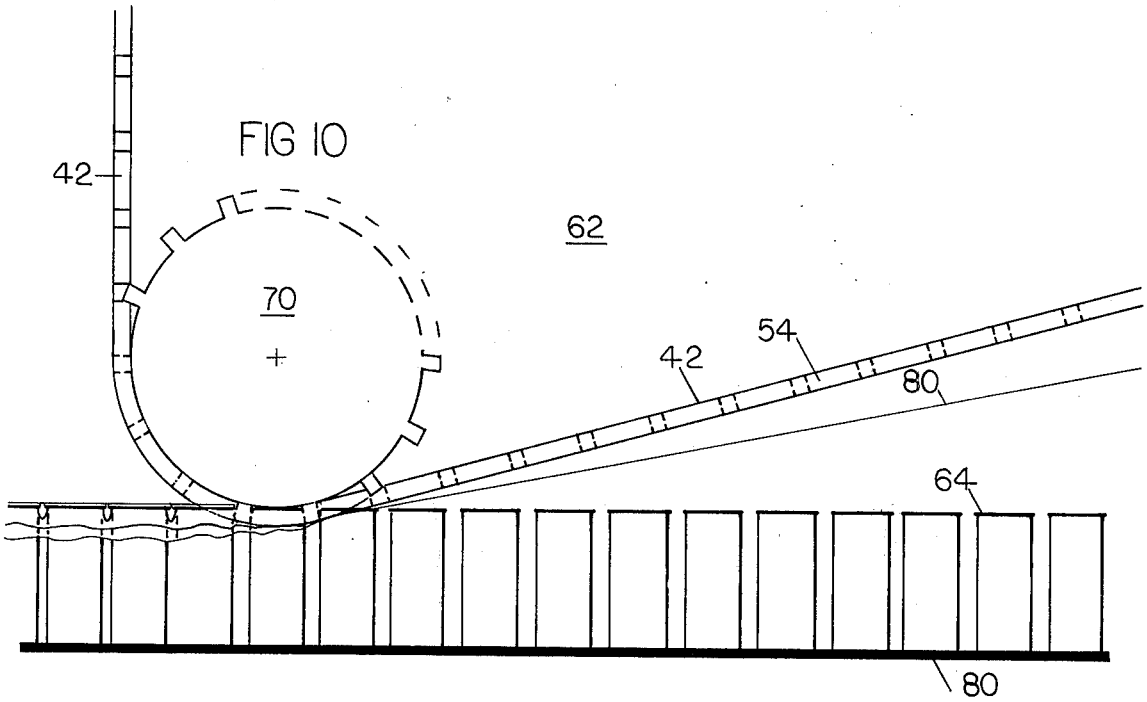
FIG. 10 is a view in cross-section of another portion of the machine shown in FIG. 8.

Details of the application station 62 are illustrated in FIG. 10. It includes an application drum 70 that deflects the belt down past the tops of the array of cans passing along the conveyor. While in this deflected position, a heat source 72 under the conveyor applies heat to the web sufficient to cause the plastic sheet material of the web to contract about the tops of the cans. The belt then separates from the web and array of cans, passing upwardly around drum 70 while the cans now interconnected by the web pass to the left as the conveyor moves along.

The finger holes pre-cut in the web 54 may interlock with projections in the various drums 46, 50 and 70 to assist in synchronizing their motions. When the web has been heated sufficiently to interconnect the array of cans, it is allowed to cool. Then it is cut by a conventional cutter at cutting station 74 (FIG. 8). This results in a series of packages each consisting an array of cans interconnected by a carrier formed by a segment of the web material.

Belt 42, and indeed most of the elements of the machine, may take any of various forms, for example, the belt 42 may be formed of a thick, flexible material such as rubber, or it may be formed of a series of metallic or rigid elements interconnected on each side by a chain or the like. Since such metallic elements will best conduct heat and are quite durable, they may be preferred for many applications.

It is estimated that such a machine will produce on the order of 5,000 6-packs per hour, packaging 30,000 cans or more per hour and taking no more than ¾ of a second to form each successive package. Obviously, this is an appreciable volume of cans. Should the plastic web material forming the carrier shrink a considerable amount during application of heat at packaging station 62, not only will the cans tend to be tipped during this shrinkage but also the space requirements will be substantial. For this reason, it is preferred that shrinkage of the web, at least in the direction of motion of the conveyor, be a minimum amount, the web being shaped by heated drum 46 and cooling drum 50 to provide a collar slightly larger than the top of the cans being packaged. Thus, minimum shrinkage produced by the heat generated by source 72 is required to interconnect the cans and produce the packages. This in turn will result in minimum tippage of the cans and a minimum amount of time required for the operation, thereby minimizing the space requirements for the packaging station.

If it is desired to cover the tops of the cans being packaged, as shown in FIG. 8 a protective film 80 may be provided, passing over idler rollers 82 and into the bite between belt 42 and can tops at packaging station 62. The belt forces the film over the can tops and the web secures the film about each can top as it contracts, as has previously been described in connection with FIG. 7.

Since sheets of such oriented plastic materials often differ somewhat in their stretch characteristics, depending upon the conditions under which they were formed, when employed to form the carrier of this invention such variations must be accounted for in shaping and cutting the carrier for it to properly contract about an array of cans, as previously noted. Plastic sheets of a material which may be expanded and set in an expanded state, but which is initially in an unexpanded state, are preferred in many applications of this invention. Not only are such sheets substantially less expensive than biaxially oriented sheets, but they also are far more controllable. Only the margin area about each opening cut in the sheet need be expanded and preformed as a collar to slip about the neck of a can or other article being packaged. Since the collar upon being heated will contract back towards its original unexpanded state, and since the area of the carrier interconnecting these collars is not expanded, not only are the cans in the array gripped uniformly by the carrier but also a strong stable intermediate sheet area interconnecting the carriers is provided; accordingly, the cans are not moved significantly during the packaging operation as the collars contract about the array. Many advantages, both economic and technical, accrue from the use of such a material. The cost per pound of a sheet of unoriented material is considerably less than the cost per pound of a sheet of oriented material. For example, a sheet of biaxially oriented polyvinyl chloride costs at present from fifteen to twenty-five percent more per pound than a sheet of such material in an unoriented state.

Figure 11:
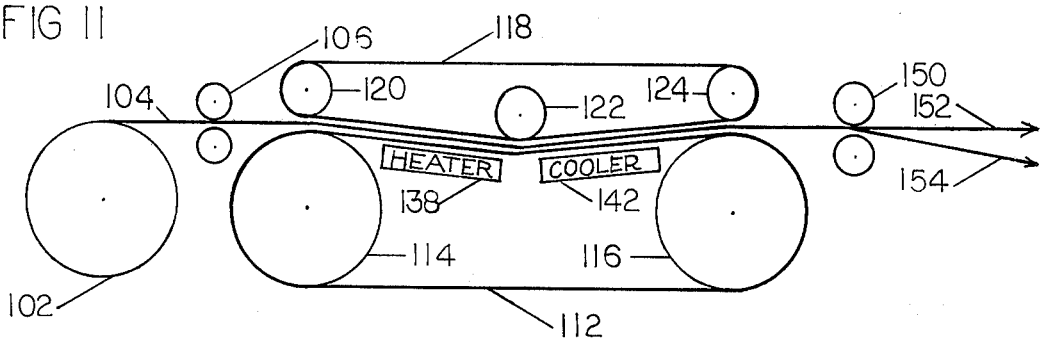
FIG. 11 is a plan view of the major elements of a machine for forming a carrier web from a strip of unexpanded material.
Figure 12:
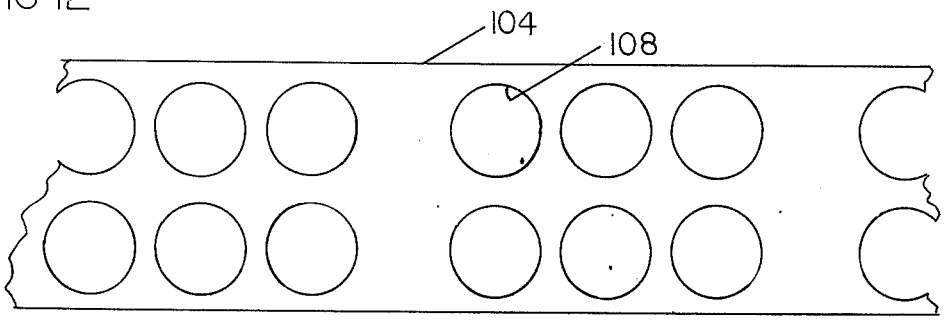
FIG. 12 is a view of a portion of the carrier strip as it is being formed in the machine of FIG. 11.

A machine for preforming a sheet of such an unexpanded or unoriented material generally is indicated in FIG. 11; subsequent figures illustrate elements of this machine and the carrier sheet during various stages of its preforming by the machine. The machine is designed to process a sheet of an expandable material, such as polyvinyl chloride, carried on a supply roll 102. Assuming that this sheet 104 has not been pre-cut into a carrier web, it is first fed through the bite of a pair of sheet cutting rolls 106 which cut openings in the sheet in a pattern to receive consecutive arrays of cans. Each set of openings is spaced from adjacent sets by distance adequate to provide the interconnecting convoluted strips or expandable elements as will subsequently be described. The sheet 104 after leaving cutter rolls 106 is illustrated in FIG. 12, the can openings being designated by reference character 108. While this figure illustrates a sheet bearing the openings in a given orientation and only wide enough for two adjacent openings, it should be understood that the machine may be designed, and the sheet may be wide enough, to preform a series of adjacent array sets, the openings being in any desired pattern. The pattern and width shown in FIG. 12 is employed simply to illustrate the principals of this invention.

Figure 13:
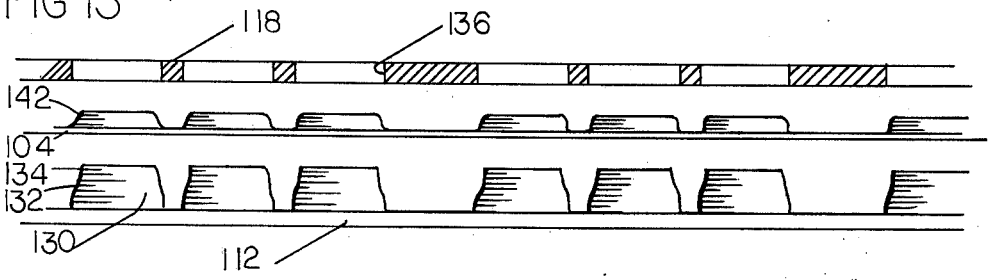
FIG. 13 is an exploded view of a portion of the forming machine and the carrier strip.

The machine next passes the sheet between a forming belt 112 which passes around rollers 114 and 116, roller 114 being heated, and a clamping belt 118 which passes around rollers 120, 122, and 124. Preferably opposed rollers 114 and 120, and 116 and 124, are slightly spaced from one another so that the belts gradually engage and disengage. Roller 122 is provided to exert force on the adjacent belts adequate to securely clamp the sheet between these belts. As shown in FIG. 13, and exploded sectional view illustrating the relationship of sheet 104, forming belt 112, and clamping belt 118, the forming belt consists of a series of upstanding forms 130 each consisting of a conical lower section 132 and a generally cylindrical upper section 134. The diameter of the cylindrical section 134 is slightly less than that of openings 108 in sheet 104. The spacing of the forms 130 along the forming belt 112 are identical to the spacings of openings 108 in sheet 104. Thus, sheet 104 will readily nest with forming belt 112. Clamping belt 118 also incorporates a series of openings 136 of a diameter approximately equal to the diameter of the base of conical section 132 of the forming belt. These openings also are spaced to overlie openings 108 in sheet 104 and to nest with the raised forms 130 of the forming belt 112. The purpose of the clamping belt is to force sheet 104 down on the forming belt 112 during the preforming operation, a process which occurs as the sheet is carried between these two belts from the heated roller 114 to the roller 116.

The forming belt preferably is made of a material that is highly conductive, such as aluminum, so that the forming belt may be rapidly heated and cooled. It is preferred that clamping belt 118 be made of a material that is quite insulating or non-conductive, such as for example a phenolic resin material, so that it does not substantially increase or decrease in temperature during the preforming operation, thus not adding to the thermal load of the system. Each belt is provided with a series of hinges (not shown) so that it will flex and follow the curvature of the rollers over which it passes. Preferably the hinges on the forming belt are provided between the raised forms 130 and the hinges on the clamping belt are provided adjacent openings 136 generally in line with a transverse diameter across these openings. Of course, while belts are shown as being employed in this machine, it is also feasible to use a heated forming roller and a cooled setting roller, and to carry the sheet about portions of these rollers employing a belt such as used in connection with the machine shown in FIG. 8.

Figure 14:
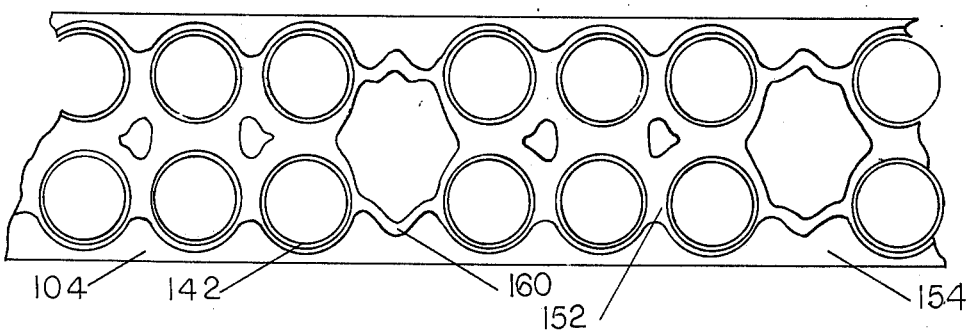
FIG. 14 is a view of the carrier web after it has been formed and cut.

As sheet 104 passes into the engagement with the forming belt 114, it enters the bite between rollers 114 and 120. Openings 108 in the sheet will engage with the cylindrical portions 134 of the raised areas 130 on the forming belt and begin to nest with the forming belt. The forming belt having passed around heated roller 114 has been raised to a temperature sufficient to render the sheet material 104 somewhat pliable. Thus, as the sheet material engages the forming belt, the margin area surrounding each opening 108 in the sheet is heated to a temperature at which it becomes thermoplastic or pliable, permitting clamping belt 118 gradually to urge sheet 104 down onto the forming belt 118 gradually to urge sheet 104 down onto the forming belt until it rests completely on the forming belt, openings 136 in the clamping belt then being fullly seateed about raised areas 130 in the forming belt. A heater 138 is provided adjacent roller 114 to maintain the belts and the sheet at a temperature sufficient to render the sheet thermoplastic during this seating operation. Roller 122 by pressing the belts together, encourages this gradual seating as sheet 104 is formed by belt 112. This formation, resulting in collar areas 142 about each opening 108 in sheet 104, is set as the belts and the sheet sandwiched between then are carried past cooler 142, which may simply be a source of low temperature air. After being so set, then sheet 104 is separated from belts 112 and 118 as it passes from the bite between rollers 116 and 124 on to shear cutter rollers 150. At this cutter, the outline of the carrier is defined by shearing away the margins of the sheet. The inner finger holes and the areas between the carriers also are sheared away by this operation, resulting in a series of interconnecting carriers as shown in FIG. 14. These shear strips are separated from the carrier web, the carrier web 152 being led either to the packaging operation or to a drum wrapping machine while the separated strip 154 are fed to a scrap system and preferably recycled.

The carrier web may be employed immediately after being formed to package an array of cans as described in connection with the machine illustrated in FIG. 8. However, this association intimately connects the carrier forming operation with the packaging operation, resulting in a shut down of the packaging line should anything go amiss during the carrier forming operation. Also, the rate at which carriers are produced is tied to the speed of the packaging line by such an association. For these and other reasons, in some applications it is desirable to be able to wrap the carrier web about a drum or to cut it into individual carriers so that the carriers may be produced elsewhere or at their own production rate, then stored or transported to the point of use. Of course, cutting the carrier web into individual carriers requires the carriers to be dispensed individually during the packaging operation, a very difficult requirement to meet reliable at the high speeds involved in most packaging operations. Thus, it is preferred that the carrier web be wrapped about a drum. However, because the carrier has been preformed with collar areas 142, should the web be wrapped about a drum without careful alignment and nesting of the collars, the collar areas would be compressed and distorted by the overlying portion of the carrier web. This distortion well could disrupt the smooth nesting of the web with the cans during the packaging operation to offset the advantages of separating the carrier formation operation from the packaging operation. For all of these reasons, it is quite desirable to nest the collar areas of each layer of the carrier about the drum with those of the preceding and subsequent layers. However, as the carrier is wrapped about a drum, the circumferential distance gradually increases. If provisions are not made for this increase, a point of stretch of the carrier web quickly will be reached that will prevent any further nesting of the collar areas.

As shown in FIG. 14, a convoluted strip section 160 may be provided between the adjacent carriers forming the web, this section permitting the carriers to be separated from one another a substantial amount without stretching the carriers of distorting the collars. To be specific, for packaging the normal beverage cans, opening 108 in sheet 104 may be cut to have a diameter of 1 13/16 inches. This opening is stretched or expanded by being seated about the forms on belt 112 to provide a collar area having a diameter of 2⅝ inches. The convolution of strip 160 between adjacent carriers is such as to permit a ⅜ inch longitudinal separation of adjacent cariers. This carrier web is wrapped about a drum having an outside diameter of 57.7 inches, the circumference being 181.5 inches. Such a size of the drum is sufficient to receive 22 consecutive carriers of the carrier web when the convoluted strips between carriers are in an unstretched state. Preferably, the drum includes raised portions about its surface to nest with the collars of the carriers thereby defining and maintaining their proper spacing. As subsequent layers of the carrier web are applied about the drum, a slight tension is applied to the carrier web sufficient to slightly stretch the convoluted strip portions connecting adjacent carriers an amount to maintain a nesting relationship of the collars on each layer with those of the preceding layer. By this arrangement, it is possible to wrap over 5,000 carriers on one drum. Of course, it is desirable, considering the speed of many packaging operations, to carry many more carriers than this on a single drum. A machine and arrangement for achieving this result is shown in FIG. 15.

Figure 15:
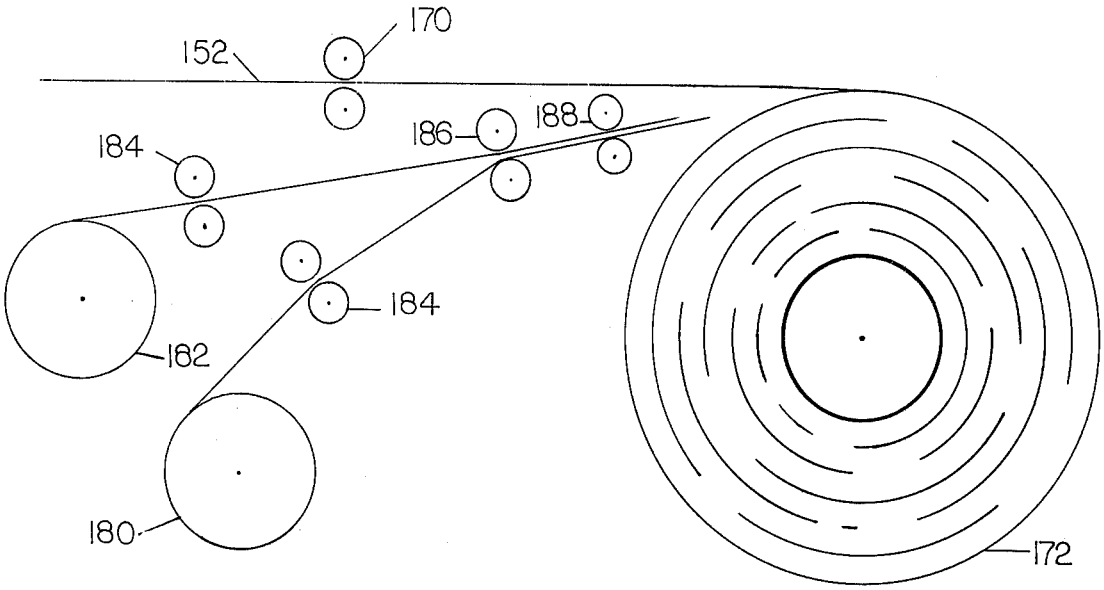
FIG. 15 is a plan view of the major elements of a machine for wrapping the carrier web about a drum for storage or transportation.

In the drum wrapping machine shown in FIG. 15, the carrier web 152 produced by an operation such as illustrated in FIG. 11 is fed between the previous layer on the drum and the layer being laid on the drum. The separator sheet both completes and protects the nested carriers just laid on the drum as well as defining the new, unexpanded association of the carrier web layer next to be applied. Such a result advantageously may be obtained by employing two separate sheets of a shaped material, such as a relatively stiff thermoplastic sheet, one sheet being carried on drum 180 and the other sheet on drum 182. These sheets may have been preformed, or they may be formed and shaped during the drum wrapping operations as they pass through the bite between forming rollers 184. The sheets next are associated back to back in a proper relationship by passing between the bites of spacing rollers 186.

At the proper time, when the carrier web being laid down on drum 172 has reached its maximum expansion, spacing rollers 186 are actuated along with drive and cutter rollers 188 to feed the inner spacer from roller 180 into the space between the carrier web being applied to drum 172 and the web already laid down on the drum. Because the sheet fed from roll 180 has been formed to nest with the carrier web already laid about 172, the web now being in its fully expanded form, it will pick up and nest in a proper association with the carrier web carried by drum 172. The spacing sheet fed by drum 182 overlies that fed by drum 180. It defines and establishes the spacing of the carrier web in an unexpanded state, this spacing sheet including upstanding areas about which the collars of the carrier web nest. Because of the relationship of the dimensions previously set forth, when the convoluted strip portions have been extended to provided substantially the full expansion between adjacent carriers in the carrier web, the circumference about the drum 172 has increased so that one additional carrier may be received about the drum by laying down the carrier web on the drum with convoluted strips 160 in substantially an unexpanded state. This spacing is the spacing defined by the raised areas on the separator strip fed from roll 182.

Figure 16:
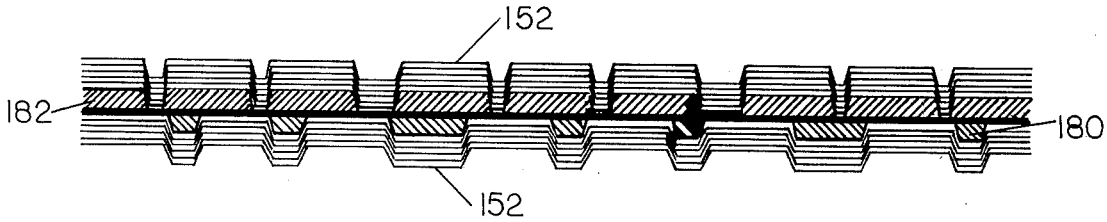
FIG. 16 is an exploded view of some of the layers wrapped about the drum of FIG. 15.

FIG. 16 illustrates in a developed relationship a portion of the carrier web 104 and the interleaved spacer section of strips 180 and 182 carried about drum 172. As it shows, the lower layers are in an extended, nesting condition and are capped by strip 180. Strip 182 commences a new, non-extended relationship of the carriers, the carriers again being received upon one another in a nesting relationship.

The separator strips are fed from rolls 180 and 182 through rollers 184, 186 and 188 for one complete revolution of drum 172, the strips being cut free by cutter rollers 188 upon completion of one revolution. Thereafter, the drum continues to receive carrier web 152 but now in an unexpanded state. As more and more layers of the carrier web are applied about the drum, gradually the convoluted or extensible strips 160 interconnecting the carriers are stretched further and further until they have again substantially reached their limit. Again an additional carrier may be laid down upon the drum. At this time, another interleaved sheet set is fed about the drum by spacing rollers 186 and cutter rollers 188 to complete the carrier section just laid down and to establish a new layer of the carrier web in its unexpanded state.

As previously noted, a drum of 57.7 inches in diameter will accomodate 22 formed carriers per circumferential layer. Since a typical carrier sheet will have a thicknes approaching 0.005 inches, by fully telescoping the formed collars areas of one layer of the carier upon the previous layer the drum will accomodate over 5,000 carriers in a layer 2.5 inches in thickness. At this point the circumference about the layer will have increased the distance of one carrier and the separator sheets may be interleaved with the carrier web to begin a new layer pattern of 23 carriers in an unexpanded state. For this, extensible strips 160 connecting the carriers should provide about 3/6 inch expansion between adjacent carrier on the web. While such inteerleaving may continue until as many carriers as aree desired are wrapped about drum 172, normally 20,000 carriers or so will be applied to the drum which number is usually sufficient for a reasonable length packaging run and which also results in a drum of manageable size.

Figure 17A:
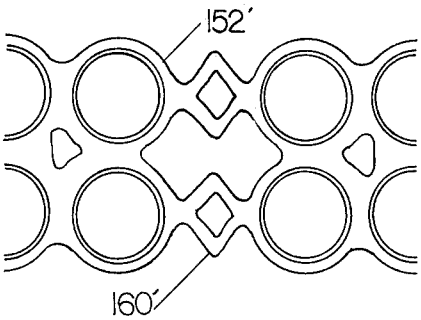
FIG. 17A and 17B are views of alternate carrier web designs.
Figure 17B:
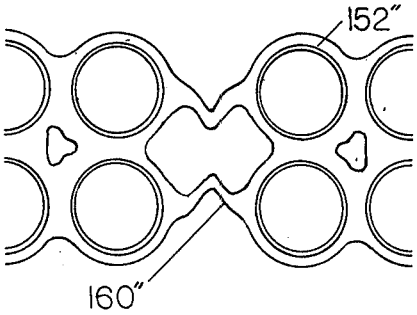

While FIG. 14 illustrates one type of convoluted or extensible strip section between adjacent carriers on the carrier web, obviously many other convoluted configurations could be employed to achieve the results just set forth. Some examples of other designs of convoluted strips are shown in FIGS. 17A and 17B, the carrier web being designated in these figures by reference characters 152' and 152" respectively, while the convoluted strip sections are designated by reference characters 160' and 160" respectively.

The carrier web carried by drum 172 may be fed to the packaging line by an arrangement of rollers such as indicated in FIG. 8 in the packaging or application station 62, the interleaved spacer strips being permitted to fall free from the drum during the packaging operation. This preformed carrier also may be employed to hold a cover film about the top of each of the cans over which it is applied during the packaging operation, thereby sealing the top of each can against contamination until it is removed from the package.

In many operations, it is quite practical to employ a carrier web that has been fully pre-cut, but which is of a material in an unexpanded, flat sheet form. It can be cut and wrapped about a drum by the sheet material manufacturer, and the trimmings recycled. Such a carrier may be expanded, performed with collars, and set by a machine and in an operation such as described in connection with FIGS. 8 or 11, the cutters 106 and 150 shown in FIG. 11 now being unnecessary. Of course, as previously noted such a formed sheet of carriers may be applied directly to an array of cans in a packaging operation, in which case the machine would include the major elements in an association such as indicated in FIG. 8.

In summary, one important advantage of the carrier provided by this invention is that it may be simply formed and easily applied about an array of cans to inteerconnect the cans as a unitary package. In addition, because of its design it may be used to hold a cover film about the top of each can, thereby sealing it against contamination. Further, while a sheet of expanded material may be used to form the carrier so employed, a sheet of a material in an unexpanded state also may be used. It is first cut, shaped and set, then by application of an external force such as heat caused to contract about the cans to form the package. While the carrier formation and packaging operations may proceed in an intimate association, one with the other, by employing a unique extensible interconnection between adjacent carriers of the carrier web, the web may be wrapped about a drum. Using interleaved separator sheets, a practical number of carriers may be received about and carried upon a single drum, the preforming of each carrier being preserved. Methods have been described for performing each of these operations as well.

While preferred embodiments of the invention have been described, variations will occur to those skilled in this art. Accordingly, the scope of the invention is defined by the following claims.

What is claimed is:

1. A carrier intended to interconnect an array of elements as a package, the carrier comprising:

a sheet made of a material which may be shrunk by application of an external force, said sheet having a plurality of openings, each intended to receive an element to be packaged, the openings being larger than the portion of the element about which the sheet is placed, said sheet having a pre-formed cylindrical collar area about each opening, said openings and the cylindrical collar areas about the openings being of a size and shape to, upon application of said external force, contract in size sufficiently to tightly hold and interconnect the elements of the array.

2. A carrier as set forth in claim 1 in which the sheet is formed of a heat shrinkable plastic material.

3. A web of carriers, each carrier of the web being as set forth in claim 2, the web further including areas interconnecting each carrier of the web with adjacent carriers.

4. A carrier set forth in claim 2 in which the plastic material shrinks by different amounts in different directions upon application of heat, the elements intended to be packaged having a circular shape in cross-section, the openings in the sheet being eliptical in shape with the major axis of the elipse aligned with the major axis of shrinkage, the eliptical openings being larger than the elements and shaped to upon application of heat shrink to a circular opening sufficiently small to hold said elements tightly.

5. A carrier as set forth in claim 1 which the portions of the sheet between said collar areas do not shrink substantially upon application of said external force.

6. A carrier as set forth in claim 3 in which the sheet is a sheet of polyvinyl chloride.

7. A web of carriers, each carrier of the web being as set forth in claim 6, the web further including areas interconnecting each carrier of the web with adjacent carrier.

8. A carrier web for interconnecting an array of elements as a package, the carrier web being formed from a sheet of a material which upon application of an external force may be expanded, then set in an expanded condition to upon subsequent application of an external force contract back towards its original state, the carrier web including a series of openings in said sheet, each opening being intended to receive an element to be packaged, the openings being larger than the portion of the element about which the sheet is placed, said sheet having a pre-formed cylindrical collar area about each opening, said openings and the cylindrical collar areas about the openings being of a size and shape to, upon application of said external force, contract in size sufficiently to tightly hold and interconnect the elements of the array, the carrier web providing a margin area about each opening and collar area, and a sheet area interconnecting the margin areas into arrays for receiving and interconnecting the elements as a package, each array defining a carrier, the carrier web also providing areas interconnecting each carrier of the carrier web with adjacent carriers, whereby the interconnected series of carriers from a carrier web.

9. A carrier web as set forth in claim 8 in which the carrier sheet is a sheet of polyvinyl chloride.

10. A carrier web as set forth in claim 8 in which a substantial length of the carrier web is wrapped about and carried upon a drum.

11. A carrier web as set forth in claim 8 in which the carrier web is formed a sheet of thermoplastic material which upon heating may be expanded then by cooling set in an expanded condition, and which upon subsequent heating may be caused to contract back towards its original unexpanded state.

12. A carrier web as set forth in claim 11 in which the web material is in a substantially unexpanded state.

13. A carrier web as set forth in claim 12 in which the web material is polyvinyl chloride.

* * * * *